US007182284B2

(12) United States Patent
Jabs et al.

(10) Patent No.: US 7,182,284 B2
(45) Date of Patent: Feb. 27, 2007

(54) COMMINUTION DEVICE

(75) Inventors: Thomas Jabs, Duisburg (DE); Frank Seehöfer, Essen (DE); Ivan Hysek, Calgary (CA)

(73) Assignee: ThyssenKrupp Fördertechnik GmbH (DE)

( * ) Notice: Subject to any disclaimer, the term of this patent is extended or adjusted under 35 U.S.C. 154(b) by 0 days.

(21) Appl. No.: 10/547,685

(22) PCT Filed: Mar. 12, 2004

(86) PCT No.: PCT/EP2004/002572

§ 371 (c)(1),
(2), (4) Date: Aug. 31, 2005

(87) PCT Pub. No.: WO2004/087324

PCT Pub. Date: Oct. 14, 2004

(65) Prior Publication Data

US 2006/0278744 A1 Dec. 14, 2006

(30) Foreign Application Priority Data

Apr. 2, 2003 (DE) ..... 103 14 958

(51) Int. Cl.
*B02C 21/02* (2006.01)

(52) U.S. Cl. ..... 241/101.74; 241/101.76

(58) Field of Classification Search ..... 241/101.74, 241/101.741, 101.75, 101.76
See application file for complete search history.

(56) References Cited

U.S. PATENT DOCUMENTS

| | | | | |
|---|---|---|---|---|
| 3,924,876 | A | 12/1975 | Vaillant et al. | |
| 6,935,587 | B2 * | 8/2005 | Brock et al. | 241/101.76 |
| 2006/0202073 | A1 * | 9/2006 | Heeszel et al. | 241/101.74 |

FOREIGN PATENT DOCUMENTS

| | | |
|---|---|---|
| DE | 12 96 949 B | 6/1969 |
| DE | 37 09 375 C | 4/1988 |
| WO | WO 02/092231 | 11/2002 |

* cited by examiner

*Primary Examiner*—Faye Francis
(74) *Attorney, Agent, or Firm*—McGlew & Tuttle, PC

(57) ABSTRACT

A crushing device is configured as a mobile or semi-mobile unit (1), in particular for use in open cast mining and in the recycling industry, with a feeding container (Z), a feeding conveyor means (3) connected downstream of this for a crusher unit (7), a discharge conveyor (8) serving to transport the crushed product therefrom and a support structure (4), on which the previously named components are held. In order to improve the feasibility of the crushing device, only a single discharge conveyor unit (8) is provided as a discharge conveyor device for both the drawing off and the discharge process. The conveyor unit (8) is constructed to slew as a subassembly in the horizontal and vertical direction relative to the support structure (4).

8 Claims, 6 Drawing Sheets

COMMINUTION DEVICE

CROSS REFERENCE TO RELATED APPLICATION

This application is a United States National Phase application of International Application PCT/EP2004/002572 and claims the benefit of priority under 35 U.S.C. § 119 of German Application DE 103 14 958.9 filed Apr. 2, 2003, the entire contents of which are incorporated herein by reference.

FIELD OF THE INVENTION

The invention relates to a crushing device configured as a mobile or semi-mobile unit, in particular for use in open cast mining and in the recycling industry, with a feeding container, a feeding conveyor means connected downstream of this for a crusher unit, a discharge conveyor means serving to transport the crushed product therefrom and a support structure, on which the previously named components (feeding container, feeding conveyor means, crusher unit and discharge conveyor means) are held.

BACKGROUND OF THE INVENTION

Crushing devices of the aforementioned type are used to reduce lump material for crushing, e.g. ores (iron ore, brown ore, copper ore, gold ore), rocks (granite, rock material, gypsum, serpentine, limestone), black coal, bituminous shale, marl, clay and overburden to a given desired particle size. Depending on the working conditions, the crusher units used in particular are hammer crushers, impact crushers, roll crushers, cone crushers, jaw crushers or rotary crushers.

The movability of the crushing devices required with respect to the face advance is assured in this case by the support structure being equipped with caterpillar crawlers, wheel travel gear or walking-type travel gear.

Semi-mobile crushing devices are configured such that they can be shifted in the desired manner by means of independent transport means, in particular by means of transport crawlers.

In the case of the appropriate crushing devices known hitherto, the crusher unit in many cases has a discharge conveyor means connected downstream of it, which consists of a discharge conveyor disposed below the crusher unit and a drawing conveyor cooperating with it, wherein the latter may also be constructed to be movable relative to the support structure.

The disadvantage of this known configuration is firstly that it has a relatively large mass as a consequence of the use of an additional drawing conveyor, wherein operation of the drawing conveyor requires the use of an appropriate drive means and is associated with an increased expenditure of energy. Secondly, the specifically highly stressed drawing conveyor—its accessibility rendered difficult as a result of its installation position between the crusher unit and the discharge conveyor—is particularly prone to wear and consequently requires repair or maintenance. The resulting relatively short service life of the drawing conveyor therefore has a detrimental effect on the feasibility of the entire crushing device.

Alternatively, appropriate crushing devices have also become known, wherein the discharge conveyor means only comprises a discharge conveyor that is not movable relative to the support structure. Consequently, the crushing device can only be adapted to changing working conditions by the crushing device itself being shifted as a unit, where necessary, and/or additional transport means being used, which cooperate with the relatively fixed discharge conveyor.

SUMMARY OF THE INVENTION

The object forming the basis of the invention is to design a crushing device of the aforementioned type such that its feasibility is increased, in particular also by reducing the requirement for maintenance and by improved adaptability to different working conditions.

The novel crushing device should also take into account the factor that appropriate mobile or semi-mobile units must be designed to be as "light" as possible because of limited ground pressures.

According to the invention, a crushing device is designed as a mobile or semi-mobile unit, in particular for use in open cast mining and in the recycling industry. The device comprises a feeding container, a crusher unit and a feeding conveyor means connected downstream of the feeding container for the crusher unit. A discharge conveyor means is provided serving to transport the crushed product from the crusher unit. A support structure is provided on which the feeding container, the feeding conveyor means, the crusher unit and the discharge conveyor means are held. The discharge conveyor means comprises a single discharge conveyor unit which is used for both a drawing off of material and a discharge process and which is constructed to slew as a sub-assembly in the horizontal and vertical direction relative to the support structure. On a side remote from the feeding container, viewed in the direction of the longitudinal extension of the support structure, the support structure has a component in the shape of a "U" with horizontal legs and an opening between the legs directed away from the feeding container. The crusher unit is disposed on the upper leg and the discharge conveyor unit is held to slew below the crusher unit in the region of the opening between the legs and is either suspended on the top leg or supported on the bottom leg to allow slewing movement around a horizontal movement axis and around a vertical movement axis.

The fundamental solution concept is therefore to provide the crushes unit with only a single discharge conveyor unit, which is used for both the drawing off and the discharge process and which is constructed to slew as a sub-assembly in the horizontal and vertical direction relative to the support structure. In other words, the novel crushing device is configured according to the principle of the "dual conveyor system", wherein the discharge conveyor unit can be slewed laterally as a sub-assembly as well as being vertically adjustable. Within the scope of the invention, the feeding conveyor means, just as the discharge conveyor unit, can be configured virtually as desired, in particular also as an apron feeder, chain conveyor or belt conveyor.

The stewing movements of the discharge conveyor means can be actuated by means of any desired drives, in particular by means of hydraulic or electro-mechanical drive means.

The discharge conveyor unit is preferably configured such that it may be slewed during the crushing process (i.e. with the crusher unit in operation). This assumes that the crushed product exiting from the crusher unit is fed to the take-up section of the discharge conveyor unit in a trouble-free manner—irrespective of its operating position and slewing movements. In the simplest case, the discharge conveyor unit may be slewed laterally around a horizontal movement rotational axis, the position of which is adapted to that of the crusher exit.

The subject of the invention is further configured in that—starting from its straight position, in which it is oriented parallel to the longitudinal extension of the support structure—the discharge conveyor unit can be slewed in horizontal direction respectively around up to 120° in clockwise or counter-clockwise direction.

In addition, within the scope of the invention the discharge conveyor unit should be configured such that—starting from its horizontal position, in which it is oriented parallel to the horizontal plane of reference of the support structure—the discharge conveyor unit can be slewed in an angle range between 30° upwards relative to the horizontal plane of reference and 20° downwards relative to the horizontal plane of reference.

A suitable plane, which is fixed by the structure of the crushing device, can be selected as horizontal plane of reference. For example, the transverse plane that runs perpendicular to the longitudinal axis of the crusher unit can be selected as horizontal plane of reference; alternatively, a plane of reference that is predetermined by the axis points of the travel gear or other support elements of the support structure may also be used.

With reference also to the accessibility and freedom of movement of the discharge conveyor unit, the crushing device should be configured in principle such that the crusher unit—and therefore the take-up section of the discharge conveyor unit adjacent to this—assumes an eccentric or also asymmetric position relative to the support structure, as viewed in the longitudinal direction thereof. The crushing device is preferably configured such that the crusher unit, just as the horizontal movement rotational axis of the discharge conveyor unit for its horizontal movement, is disposed in the last third to last quarter of the longitudinal extension of the support structure on the side remote from the feeding container (feeder bin)—viewed in the longitudinal direction of the support structure.

Independently of the above-described embodiment or additionally taking the relevant features into account, on the side remote from the feeding container—viewed in the longitudinal direction of the support structure—the crusher unit may be fastened on a cantilever arm, wherein this runs at a distance above the support elements, via which the support structure is supported on the ground—In this case, the discharge conveyor unit is constructed to slew below the cantilever arm.

Depending on whether the crushing device is configured as a mobile or as a semi-mobile unit, the support elements are formed by a travel gear or walking-type travel gear or by stationary legs resting on the ground. According to the invention, the discharge conveyor unit can either be attached to the cantilever arm to be suspended below it or be mounted below the cantilever arm on another component of the support structure.

A further advantageous embodiment of the subject of the invention is characterized in that the crusher unit and the slewing connection holding the discharge conveyor unit are arranged such that the crusher axis, in the region of which the horizontal movement rotational axis of the discharge conveyor unit is also located, lies behind the support elements—viewed from the feeding container in the longitudinal direction of the support structure and in the direction of the crusher unit—via which support elements the support structure is supported on the ground.

In the variants in question, the crusher unit and the slewing connection of the discharge conveyor unit are displaced outwards an the side remote from the feeding container (feeder bin) in such a manner that they lie outside the region of the support elements for the support structure. The advantage achieved with this in particular is that the dimensions of the crusher unit and the discharge conveyor unit are not dependent on the configuration of the support elements; moreover, the region, in which the discharge conveyor unit is held on the support structure is readily accessible for the purposes of repairs and maintenance, as is the exit region of the crusher unit.

The subject of the invention can also be further developed in that on the side remote from the feeding container—viewed in the direction of the longitudinal extension of the support structure—the support structure has a component in the shape of a "U" with horizontal legs and an opening between the legs directed away from the feeding container. In this case, the crusher unit is disposed on the upper leg, whereas the discharge conveyor unit is held to slew below the crusher unit in the region of the opening between the legs.

The U-shaped component enables the discharge conveyor unit to either be suspended on the top leg or supported on the bottom leg to allow slewing movement. In this case, use of the component in question is advantageous on the basis that the space defined by the two legs and the connecting web is accessible from both sides as well as from the face side (i.e, from the side opposite the feeding container).

A further variant of the above-outlined embodiment within the scope of the invention is characterized by the following features:

on the side remote from the feeding container—viewed in the direction of the longitudinal extension of the support structure—the support structure has a U-shaped component with horizontal legs and an opening directed away from the feeding container, the U-shaped component being disposed at a distance above the support elements, via which the support structure is supported on the ground.

On the U-shaped component a guide frame is held, which can be slewed around a horizontal movement rotational axis. In addition, the discharge conveyor unit is vertically adjustable relative to the guide frame and is constructed to be capable of following the slewing movement thereof.

Therefore, the variant in question here has a guide frame that may be slewed in horizontal direction as additional adjusting element. The discharge conveyor unit connects to this in such a manner that it can move in horizontal direction, on the one hand, and can be raised or lowered relative to the guide frame, on the other. The guide frame is preferably configured such that it engages around the U-shaped component of the support structure from the outside, i.e. such that it is supported at the same time on the respective leg above the upper leg, on the one hand, and below the lower leg, on the other.

An advantageous further development of the subject of the invention may be provided in that on the side facing the feeding container, the support structure is configured over a substantial portion of its longitudinal extension, at least in the order of magnitude of 40%, as an open frame with laterally spaced longitudinal beams between the feeding container and the end section of the feeding conveyor means on the crusher side.

As a consequence of the configuration as an open frame, use of an overflow collecting means, which is normally disposed below the feeding conveyor means to protect the area located below it, can be omitted in the respective sub-section of the support structure.

Consequently, additional devices (e.g. drive elements, control elements, power supply means) present in the embodiment with an open frame in question are disposed outside the feeding conveyor means respectively to the side in the region of the longitudinal beam forming part of the open frame. This arrangement is advantageous on the basis that—irrespective of changing working conditions—the crushing device can be subsequently equipped with an overflow collecting means—in the simplest case, in the form of a channel held below the feeding conveyor means.

The invention shall be explained in detail below on the basis of the drawings, in which heavily schematic views of advantageous embodiments are shown. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
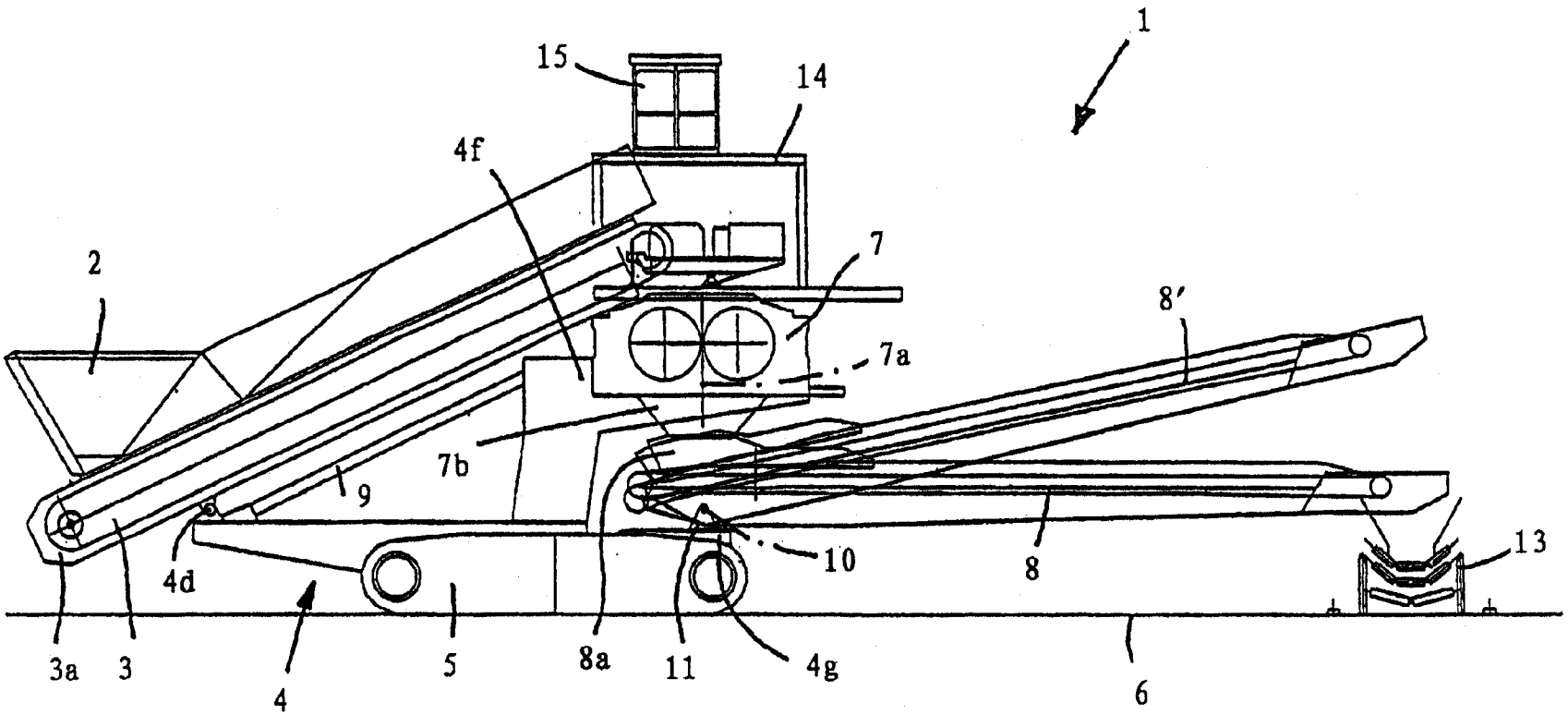
FIG. 1 is a side view of a crushing device, which is movable by means of a caterpillar crawler, wherein the discharge conveyor unit is shown in two different vertical positions.

The crushing device given the general reference 1 in FIG. 1 has the following main components: a feeding container (or feeder bin) 2, a feeding conveyor means in the form of a conveyor belt 3, a support structure 4, which is supported on the ground 6 by means of a caterpillar crawler 5, a crusher unit in the form of a dual-roll crusher 7 and a discharge conveyor unit 8 in the form of a conveyor belt. On the side facing the feeding container 2—as evident from FIG. 2—the support structure 4 is configured as an open frame, which consists of two spaced longitudinal beams 4*a* and 4*b* and also a cross beam 4*c* connecting these to one another. The conveyor belt housing 3*a* of the conveyor belt 3 is held on the support structure 4 via a bearing means 4*d*.

Figure 3:
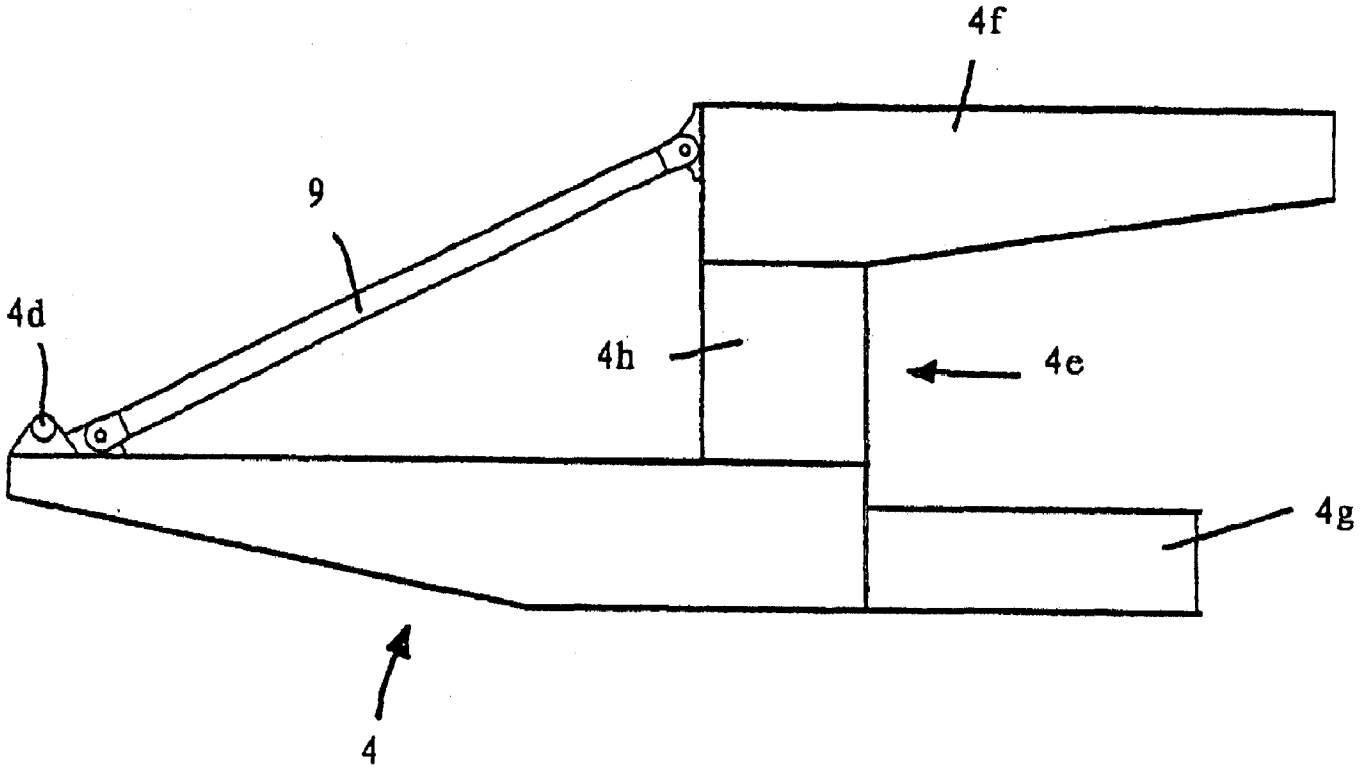
FIG. 3 is a side view shown on an enlarged scale relative to FIG. 1 of a part of the support structure (with the caterpillar crawler omitted)

The support structure 4 has a U-shaped component 4*e* on the side remote from the feeding container 2 (i.e. on the right in FIG. 3). This U-shaped component—viewed from the side—is composed of two horizontal legs 4*f* and 4*g* with an opening remote from the feeding container 2 and a connecting web 4*h*. The upper leg 4*f* is connected to the cross beam 4*c* on the side facing the feeding container 2 via at least one support rod 9. As is shown schematically in FIG. 1, the dual-roller crusher 7 is disposed at a distance above the discharge conveyor unit 8, which it self connects to the lower leg 4*g* of the U-shaped component 4*e* so that it can be slewed in horizontal and vertical direction.

For this purpose, the discharge conveyor unit 8 is articulated via a vertical movement axis 10 (lying perpendicular to the plane of the drawing) to a rotary bracket 11, which is itself capable of slewing movement around the longitudinal axis 7*a* of the dual-roll crusher 7 relative to the lower leg 4*g*.

Figure 2:
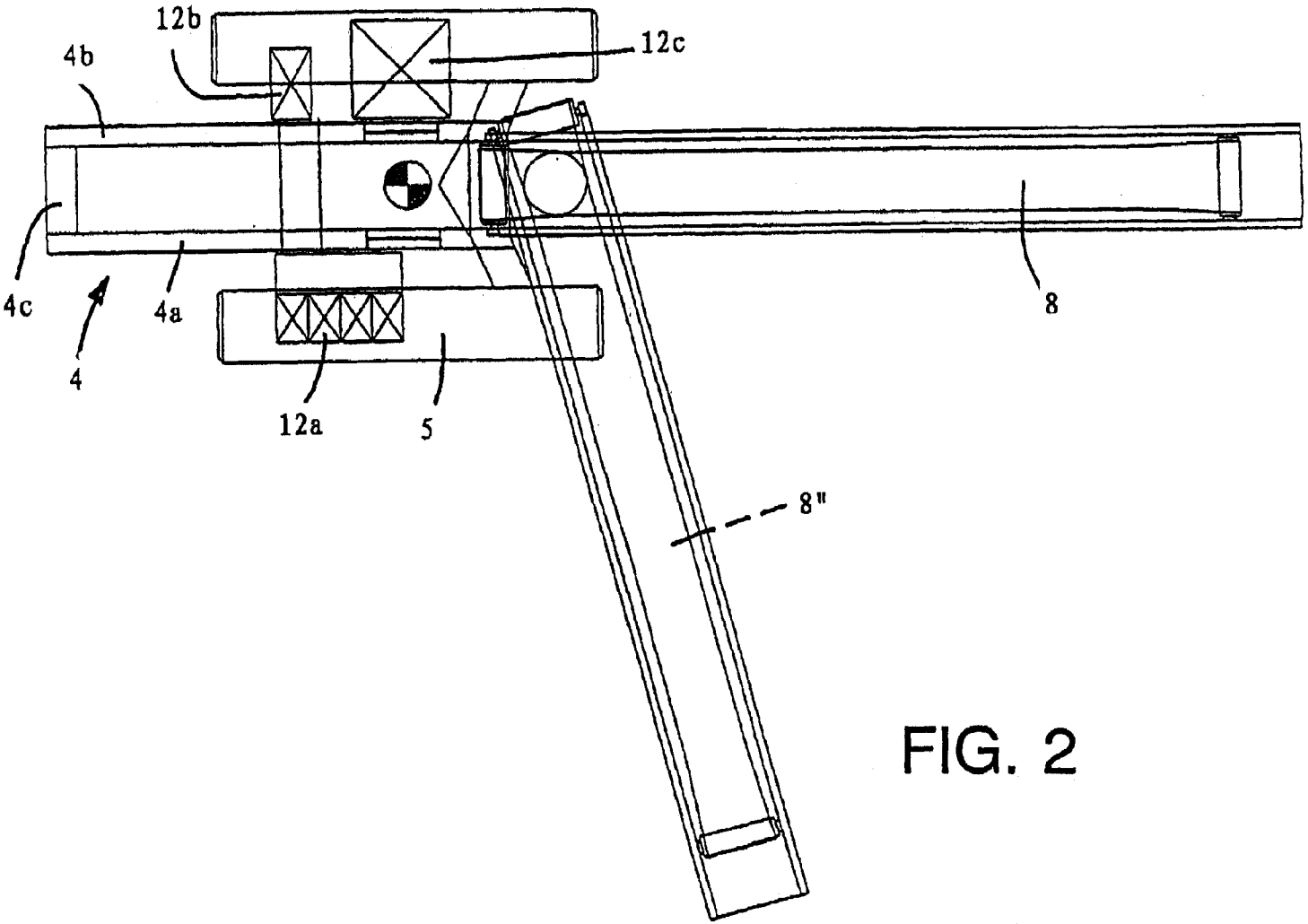
FIG. 2 is a plan view onto some essential components of the crushing device according to FIG. 1.

As may be seen from FIG. 1,—starting from its horizontal position, in which it is oriented parallel to a horizontal plane of reference (e.g. to the transverse plane to the longitudinal axis 7*a*) of the support structure 4—the discharge conveyor unit 8 can be slewed around the vertical movement axis 10 in counter-clockwise direction; in the case of the shown slewing position 8', the slewing angle achieved amounts to 12°. The rotary bracket 11 enables the discharge conveyor unit 8 to slew in horizontal direction relative to the support structure 4. FIG. 2 shows a slewing position 8" of the discharge conveyor unit 8, which—starting from the straight position, in which the discharge conveyor unit is oriented parallel to the longitudinal extension of the support structure 4—has been achieved by a slewing movement in clockwise direction around 75°.

The view in question additionally shows that additional means 12*a* to 12*c* (e.g. for drive means, control means, power supply means) are respectively disposed laterally next to the longitudinal beams 4*a* and 4*b*. Consequently, overflowing material produced in the region of the conveyor belt 3 can exit downwards practically unhindered so that—as may be seen in FIG. 1—the use of an overflow collecting means below the conveyor belt 3 is unnecessary.

Moreover, it may be seen from FIG. 1 that the dual-roll crusher 7 and the slewing connection of the discharge conveyor unit 8 are disposed on the side remote from the feeding container 2 approximately in the last quarter of the longitudinal extension of the support structure 4 with the result that the region between the dual-roll crusher 7 and the lower leg 4*g* with the rotary bracket 11 is readily accessible, in particular also for maintenance purposes.

In the direction of the discharge conveyor unit 8, the dual-roll crusher 7 is equipped in a manner known per se with a discharge hopper 7*b*, which projects to a lesser or greater distance into a channel-shaped take-up section 8*a* of the discharge conveyor unit 8.

The crushed product obtained by means of the dual-roll crusher 7 passes onto the discharge conveyor unit 8 via the intermediate connection of parts 7*b* and 8*a*, and can be transferred to an ongoing transport belt 13 by means of this conveyor unit. A driver's cabin 15 is provided above the support structure 4 on support elements 14 of no further interest here.

Within the framework of the invention, the freedom of movement of the discharge conveyor unit 8 may be extended by appropriate configuration and arrangement of parts 10 and 11 such that the discharge conveyor unit 8 can also be slewed downwards relative to the support structure 4—starting from the horizontal position shown in FIG. 1.

Moreover, the discharge conveyor unit 8 can also be moved in counter-clockwise direction (i.e. upwards in the drawing)—starting from the straight position shown in FIG. 2. The embodiment of the crushing device shown in FIGS. 4 and 5 L is equipped with a multiple-crawler travel gear 16, the three crawler pairs 16*a* of which are held to slew on a travel gear platform 16*b*. The support structure 4 is movably mounted on this platform via a rotary connection 16*c*.

In contrast to the previously described embodiment, on the side remote from the feeding container 2—viewed in the direction of the longitudinal extension of the support structure—the support structure 4 is equipped with a cantilever arm 4*i* angled upwards in this direction, which projects far beyond (to the right in the drawing) the multiple-crawler travel gear 16 and is fastened to one crusher unit in the form of a dual-roll crusher 7.

In this case, the dual-roll crusher 7 assumes a position relative to the multiple-crawler travel gear 16, in which the crusher axis 7*a*—on the side of the crushing device 1 remote from the feeding container 2—lies at a distance in front of the two front crawler pairs 16. Similar applies with respect to the arrangement of the articulated connection for the discharge conveyor unit 8, which is shown in FIG. 4 in two different vertical positions 8' and 8'''.

Figure 4:
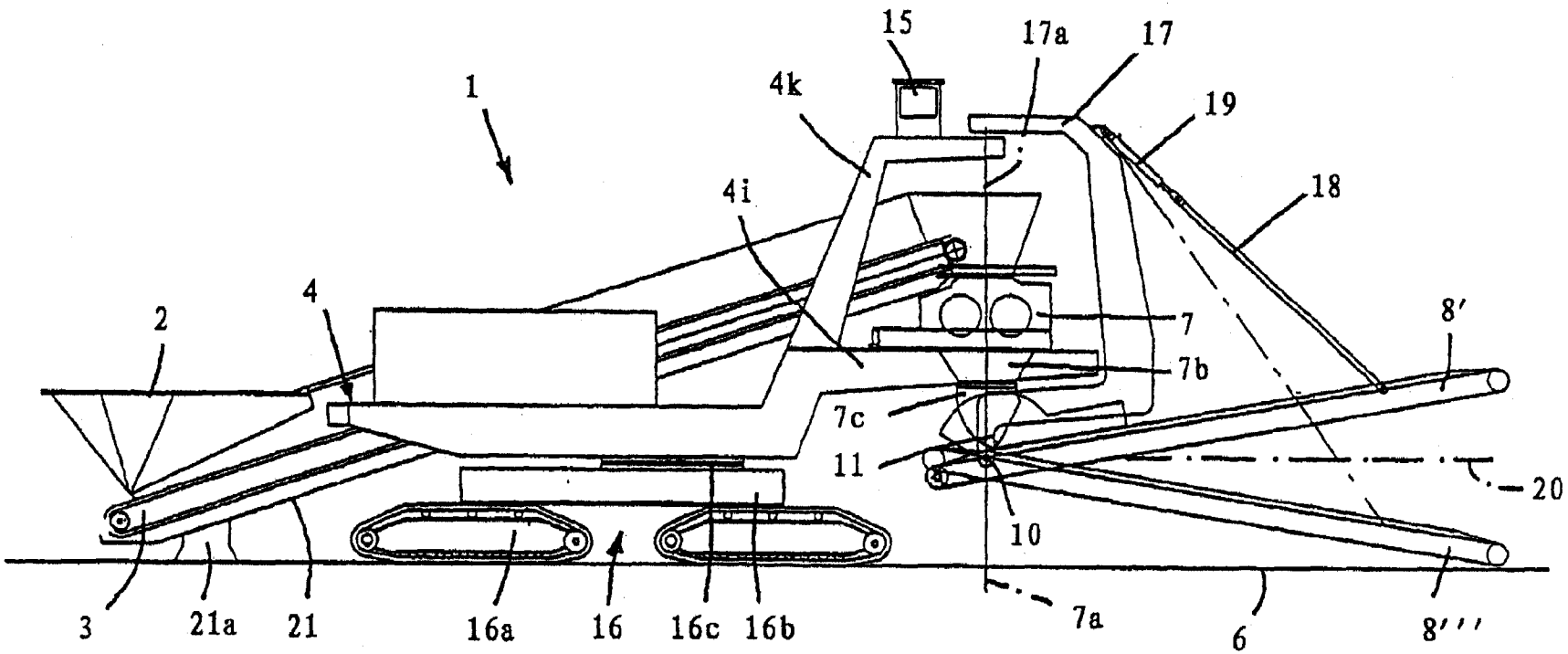
FIG. 4 is a side view of a crushing device with a guide frame, which can be slewed laterally relative to the support structure, as mounting for the discharge conveyor unit.

As may also be seen from FIG. 4, the support structure 4 is equipped with an angled arm 4*k*—lying in front of the dual-roll crusher 7 viewed from the feeding container 2; components 4*i* and 4*k* in turn together form a laterally open, approximately U-shaped component with a face-side opening directed away from the feeding container 2, in which the dual-roll crusher 7 is disposed.

Above and below the U-shaped component on the angled arm 4*k* or the cantilever arm 4*i*, a guide frame 17 is mounted to slew in horizontal direction, the frame axis 17*a* of which coincides with the crusher axis 7*a*.

Below the guide frame 17, the discharge conveyor unit 8 is held via a rotary bracket 11 to be vertically adjustable around a vertical movement axis 10.

For the purpose of vertical adjustment relative to the guide frame 17, the discharge conveyor unit is equipped on both sides with guide rods 18 articulated thereon; these in turn connect to retractable and extendable cylinder units 19, which are articulated on the guide frame 17 above the angled arm 4*k*. By retracting or extending the cylinder units 19, the vertical position of the discharge conveyor unit can be infinitely varied relative to the guide frame 17.

Two different vertical positions of the discharge conveyor unit relative to a horizontal plane of reference 20 are shown in FIG. 4. In the vertical position with the reference 8', the discharge conveyor unit is slewed upwards by about 10°; contrary to this, the discharge conveyor unit assumes a position slewed downward by about 10° in the vertical position with the reference 8'''.

It is self-evident that the parts 18 and 19 must be configured—such that the discharge conveyor unit follows the movement of the guide frame 17 perfectly around its frame axis 17*a* also in operating mode.

In the shown embodiment, the horizontal plane of reference is oriented parallel to the plane of the rotary connection 16*c*, via which the support structure 4 is movably held relative to the multiple-crawler travel gear 16.

Figure 5:
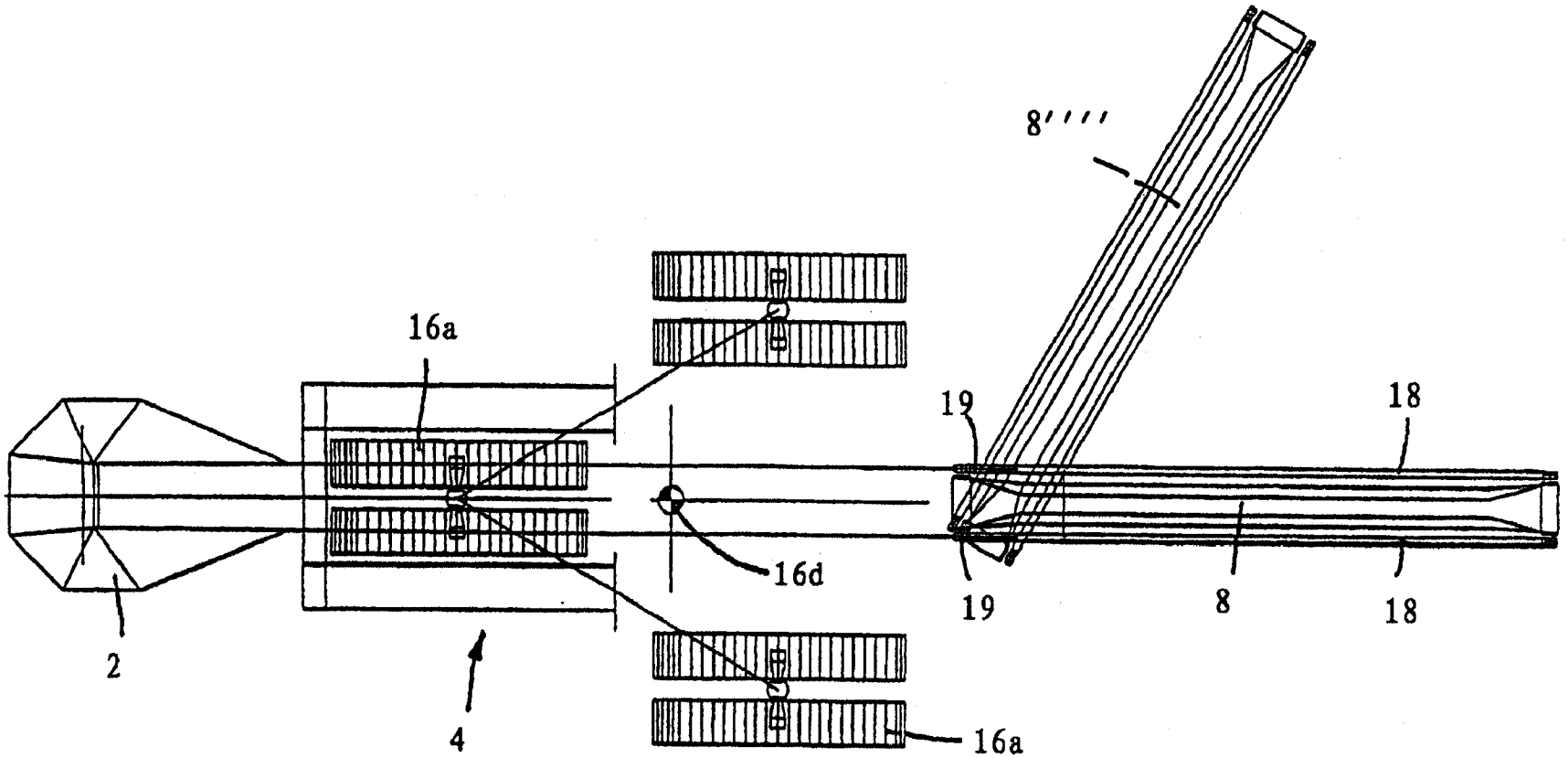
FIG. 5 is a plan view onto the caterpillar crawler of the crushing device according to FIG. 4, wherein the discharge conveyor means is shown in the straight position and in a position slewed in counter-clockwise direction.

As a consequence of the movable arrangement of the guide frame 17, the discharge hopper 7*b* of the dual-roll crusher 7 merges below the cantilever arm 4*i* into a transfer head 7*c*, which is likewise held on the cantilever arm 4*i* to slew around the crusher axis 7*a*.

Where necessary, the crushing device 1 (as indicated in FIG. 4) can be additionally or subsequently equipped with a channel-type overflow collecting means 21, which runs below the conveyor belt 3 in the region between the feeding container 2 and the dual-roll crusher 7, In the embodiment, the overflow collecting means is supported on the ground 6 in the vicinity of the feeding container 2 via a support means 21*a* on one side, and held in the vicinity of the dual-roll crusher 7 on the other. FIG. 5 shows the position and mutual arrangement of the three crawler pairs 16*a* forming the multiple-crawler travel gear 16 and the position of the rotation point 16*d* of the rotary connection 16*c*.

The figure additionally shows the straight position of the discharge conveyor unit 8, in which this is oriented parallel to the longitudinal extension of the support structure 4, and additionally a position given the reference 8'''', which the discharge conveyor unit assumes after slewing in counter-clockwise direction around approximately 60°—starting from its L straight position.

The advantage of the embodiment according to FIGS. 4 and 5 is primarily that with its attachment to the support structure 4 the discharge conveyor unit 8 is disposed completely outside the region of the multiple-crawler travel gear 16 and is therefore readily accessible for the purposes of repairs and maintenance. Similar applies to the accessibility of the dual-roll crusher 7 and the respectively associated further components—in view of the laterally open configuration of the U-shaped component comprising the arms 4*i* and 4*k*.

Moreover, the freedom of movement of the discharge conveyor unit 8—as a consequence of the already mentioned "eccentric" arrangement on the support structure 4—can also be designed to be relatively high in vertical direction, as a result of which the range of use and feasibility of the crushing device 1 increase accordingly.

Figure 6:
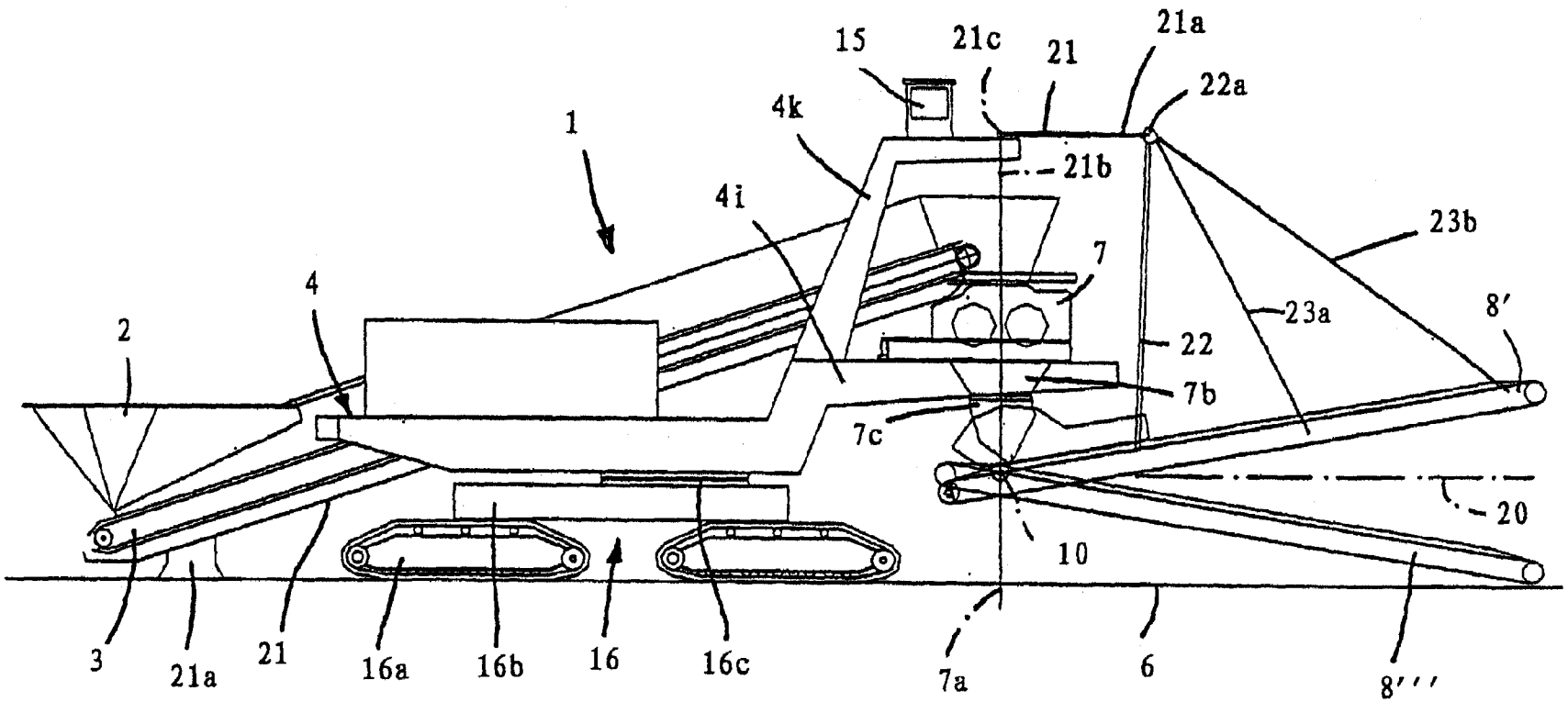
FIG. 6 is a side view of a crushing device with a different mounting for the discharge conveyor unit from that in FIGS. 4, 5.

The embodiment shown in FIG. 6 differs from the previously explained embodiment in that no guide frame is present. Instead of this, the discharge conveyor unit 8 is held above the dualroll crusher 7 on a cylinder unit 21, which can be moved, on the one hand, around a vertical axis 21*b* and, on the other, around a (not shown) horizontal axis 21*c* (oriented perpendicular to the plane of the drawing). The vertical axis 21*b* coincides with the crusher axis 7*a* in the shown embodiment.

The cylinder unit 21 is articulated to the cross beam 22*a* via its retractable and extendable piston rod 21*a*. Push rods 22 and cable rigging 23*a* or 23*b* articulated on both sides of the discharge conveyor unit 8 extend from this cross beam. The mounting of the discharge conveyor unit in question is therefore configured such that—starting from a horizontal plane of reference 20—the conveyor unit can be raised by retracting the cylinder unit 21 into the vertical position with the reference 8' or can be lowered by extending it into the vertical position with the reference 8'''.

With the retracting and extending movement of the cylinder unit, this is simultaneously slewed around the horizontal axis 21*c*. The vertical axis 21*b* enables the discharge conveyor unit to be moved relative to the support structure 4 into or out of the plane of the drawing, in which case under the action of components 22, 22*a*, 23*a* and 23*b*, the cylinder unit 21 follows the slewing movement of the discharge conveyor unit 8 around the vertical axis 21*b*.

The slewing movement relative to the last-mentioned vertical axis is actuated by a motor-driven ball bearing swivel joint (not shown) provided below the dual-roll crusher 7 on the cantilever arm 4*i*.

With respect to the further components and the resulting configuration of the crushing device, reference is made to the embodiment according to FIGS. 4 and 5.

The solution concept according to the invention may fundamentally be applied irrespective of how the crusher unit, the feeding conveyor means, the discharge conveyor unit and the devices used for operation as a mobile or semi-mobile unit are otherwise configured.

In particular, the feeding conveyor means and the discharge conveyor unit may also be configured—possibly also differing one from the other—as apron feeder, chain conveyor or belt conveyor.

While specific embodiments of the invention have been shown and described in detail to illustrate the application of the principles of the invention, it will be understood that the invention may be embodied otherwise without departing from such principles.

The invention claimed is:

1. A crushing device designed as a mobile or semi-mobile unit for use in open cast mining and in the recycling industry, the device comprising:

a feeding container;

a crusher unit;

a feeding conveyor means connected downstream of said feeding container for said crusher unit;

a discharge conveyor means serving to transport the crushed product from said crusher unit; and a support structure, on which said feeding container, said feeding conveyor means, said crusher unit and said discharge conveyor means are held, said discharge conveyor means comprising a single discharge conveyor unit, which is used for both a drawing off of material and a discharge process and which is constructed to slew as a sub-assembly in the horizontal and vertical direction relative to the support structure wherein on a side remote from the feeding container, viewed in the direction of the longitudinal extension of the support structure, said support structure has a component in the shape of a "U" with horizontal legs and an opening between the legs directed away from the feeding container and the crusher unit is disposed on the upper leg and the discharge conveyor unit is held to slew below the crusher unit in the region of the opening between the legs and is either suspended on the top leg or supported on the bottom leg to allow slewing movement around a horizontal movement axis and around a vertical movement axis.

2. A device according to claim 1, wherein the discharge conveyor unit is configured such that it may be slewed during a crushing process.

3. A device according to claim 1, wherein starting from a straight position, in which said discharge conveyor unit is oriented parallel to the longitudinal extension of the support structure said discharge conveyor unit can be slewed in horizontal direction respectively around up to 120° in clockwise or counter-clockwise direction.

4. A device according to claim 1, wherein starting from a horizontal position, in which said discharge conveyor unit is oriented parallel to the horizontal plane of reference of the support structure said discharge conveyor unit can be slewed in an angle range between 30° upwards relative to the horizontal plane of reference and 20° downwards relative to the horizontal plane of reference.

5. A device according to claim 1, wherein the crusher unit, just as the horizontal movement rotational axis of the discharge conveyor unit for its horizontal movement, is disposed in the last third to last quarter of the longitudinal extension of the support structure on the side remote from the feeding container—viewed in the longitudinal direction of the support structure.

6. A device according to claim 1, wherein on the side remote from the feeding container—viewed in the longitudinal direction of the support structure—the crusher unit is fastened on a cantilever arm, which runs at a distance above support elements, via which the support structure is supported on the ground, and that the discharge conveyor unit is constructed to slew below the cantilever arm.

7. A device according to claim 1, wherein the crusher unit and the slewing connection holding the discharge conveyor unit are configured such that the crusher axis, in the region of which the horizontal movement rotational axis of the discharge conveyor unit is also located, lies behind support elements—viewed from the feeding container in the longitudinal direction of the support structure and in the direction of the crusher unit—via which support elements the support structure is supported on the ground.

8. A device according to claim 1, wherein on the side facing the feeding container, the support structure is configured over a substantial portion of its longitudinal extension, at least in the order of magnitude of 40%, as an open frame with laterally spaced longitudinal beams between the feeding container and the end section of the feeding conveyor means on the crusher unit side.

* * * * *